US007591382B2

(12) United States Patent
Brock

(10) Patent No.: US 7,591,382 B2
(45) Date of Patent: Sep. 22, 2009

(54) COSMETIC ORGANIZER AND STORAGE SYSTEM

(76) Inventor: Barbara Brock, 166 E. 61st, #6E, New York, NY (US) 10021

( * ) Notice: Subject to any disclaimer, the term of this patent is extended or adjusted under 35 U.S.C. 154(b) by 95 days.

(21) Appl. No.: 11/491,828

(22) Filed: Jul. 24, 2006

(65) Prior Publication Data

US 2008/0017596 A1 Jan. 24, 2008

(51) Int. Cl.
*B42F 17/00* (2006.01)

(52) U.S. Cl. ..... 211/10

(58) Field of Classification Search ..... 211/10, 211/11, 126.1, 126.2, 126.13, 184, 126.7; 206/561, 557, 558
See application file for complete search history.

(56) References Cited

U.S. PATENT DOCUMENTS 4,384,647 A * 5/1983 Schweizer ..... 206/371
4,429,796 A * 2/1984 Sussman ..... 211/11
4,441,615 A * 4/1984 Goodrich ..... 206/511
4,821,751 A * 4/1989 Chen ..... 132/295
5,011,018 A * 4/1991 Keffeler ..... 206/532
5,192,042 A * 3/1993 Wotring et al. ..... 248/176.1
5,265,735 A * 11/1993 Hassel et al. ..... 211/11
5,337,890 A * 8/1994 Lai ..... 206/235
5,358,100 A * 10/1994 Wolff ..... 206/749
5,377,850 A * 1/1995 Liaw ..... 211/163
5,657,582 A * 8/1997 Chitwood ..... 52/16
5,657,880 A * 8/1997 Birnbaum ..... 211/50
5,941,255 A * 8/1999 Chen ..... 132/315
6,092,672 A * 7/2000 Harris et al. ..... 211/11
6,719,880 B2 * 4/2004 Speaks et al. ..... 162/72
6,796,431 B1 * 9/2004 Goldring ..... 206/581
2007/0205166 A1 * 9/2007 Meinhardt ..... 211/70.6

* cited by examiner

*Primary Examiner*—Jennifer E. Novosad

(57) ABSTRACT

A modular cosmetic system for storing cosmetic items in an organized fashion. In particular, a device and system that is configured to interchangeably fit modular boxes. Each modular box can be removably arranged inside the trays, permitting a user to customize the structure of their cosmetic system. The modular cosmetic system includes nine different sized modular boxes for holding different products. This allows for the creation of a unique, adjustable box to store a variety of different makeup products and the like.

10 Claims, 7 Drawing Sheets

COSMETIC ORGANIZER AND STORAGE SYSTEM

FIELD OF THE INVENTION

The invention relates to a modular cosmetic system for storing cosmetic items in an organized fashion. In particular, an improved device and system is disclosed that is uniquely configured to interchangeably fit modular boxes. This construction advantageously allows the creation of a unique adjustable box and/or tray system for organizing and storing makeup and the like.

BACKGROUND OF THE INVENTION

Containers are commonly designed to hold and store cosmetic products. Covered and uncovered containers are known for holding cosmetics and jewelry. Boxes containing a hinged cover are known, allowing a plurality of tiered and fixed sized and shaped compartments to move forward when the cover is opened. Soft pouches are known for storing makeup, including multiple pouches having zippers. Containers for storing makeup seek to organize the cosmetic products, allow the user to have easy access to each product, protect and preserve the products, while not taking up too much space.

Most containers for storing these products are rigid and do not allow adjustment. Boxes with hinged covers contain predetermined sized and shaped inner tray and therefore the interior space for storing and accessing cosmetics is limited. Due to the foldout tray mechanism the box may be heavy. Moreover, if a product does not fit into the predetermined sized and shaped tray, the tray and compartments cannot be altered.

Soft zippered pouches are primarily for travel and are designed to hold a small amount of products. These pouches do not allow organization, as all of the products are stored together in one bag. While the addition of one or two separate zippered pouches may aid in organization, it still does not provide complete organization, as items are commonly lost towards the bottom of the pouch.

Acrylic open boxes constructed in compartmental form allow the storing of products. These open boxes generally come in a pre-formed structure with immovable open compartments. These compartments usually are sized to fit popular products. They do not allow storage of non-commonly sized products.

There are twenty-eight (28) basic cosmetic categories including blush brushes, eyebrow brushes, eyelash brushes, eyeliner brushes, eyeshadow brushes, fan or bronzer brushes, powder brushes, concealer, eyebrow pencil, eyelash curler, eyeliner pencil, eyeliner powder, eyeshadow, foundation, glitter, kleenex, lipstick, lipstick liner, mascara, moisturizer, pencil sharpener, powder/bronzer, powder puff, primer, Q-Tips, rouge, sponges and tweezers. Each cosmetic category generally has its own specific shape and size. Most prior art cosmetic storage containers can only store a limited categories of cosmetics because of the fixed sized and shaped of the compartments.

Therefore, there is a need for a cosmetic organizer and storage system that utilizes different tray options for storing various cosmetic products of different shapes and sizes, and allowing the creation of a customized system with interchangeable modular boxes on selective tray(s) for organization and storage.

SUMMARY OF THE INVENTION

The present invention is a modular system for storing cosmetic items in an organized fashion. The cosmetic system is uniquely configured to interchangeably fit modular boxes and allows the creation of a unique, adjustable box to store makeup and the like. The modular boxes of the cosmetic system vary in size and height giving a user visual access to all items stored in the modular boxes.

The cosmetic storage system of the present invention comprises a tray and at least one modular box. The tray has a base, first, second, third and fourth walls. The walls extend upward from the base defining an internal area. The base of the internal area has parallel, equally spaced apart, grooves.

Each modular box comprises a support base, four walls and four legs. The four walls extend upward from a first side of the support base defining an internal storage area and an outer footprint. The four legs extend from a second side of the support base of the modular box. Each leg may be located at each corner of the support base of the modular box and fit within the dimensions of the footprint. Each leg of the modular box is sized to fit within the grooves on the base of the tray. The footprint and position of the legs of each modular box is correspondingly sized to be multiples of the spacing between the grooves. The plurality of modular boxes can be selectively and removably arranged within the internal area. The modular boxes can be square, rectangular or any other shape and preferably the footprints and legs position correspond to the groove spacing. In the preferred embodiment the system includes a set of nine different sized modular boxes each specifically designed and sized for the twenty-eight basic cosmetic categories. Each modular box may be used separately and independently and can be mixed and matched to fit within the internal area of the tray for a customized configuration. Each modular box may also further comprise a magnet that is capable of creating a magnetic force with the base of the tray.

The tray may include a drawer tray. The tray may include a tissue box holder or dispenser and/or a pencil sharpener. The pencil sharpener may be removable. The tray may include handles for portability.

The tray may contain a lid member for covering the tray and the modular boxes.

The tray may contain an aperture for a mirror. The aperture is internally threaded to cooperatively engage a correspondingly sized threaded handle of the mirror. The mirror may be detachable from the system. The mirror may be lighted.

The tray may be made from any material, e.g. plastic, metal, wood or covered with fabric.

In another embodiment of the present invention the modular system of the present invention comprises at least two trays abutting each other and at least one modular box. The two abutting trays share a common wall, with the two trays in a two-tiered configuration. The second tier of the tray is on an elevated platform. The common wall extends higher than the other walls to allow for the two-tiered configuration. This embodiment of the modular system further comprises an open compartment abutting the two trays. This embodiment may include a tissue holder or dispenser, drawer tray and/or a pencil sharpener.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
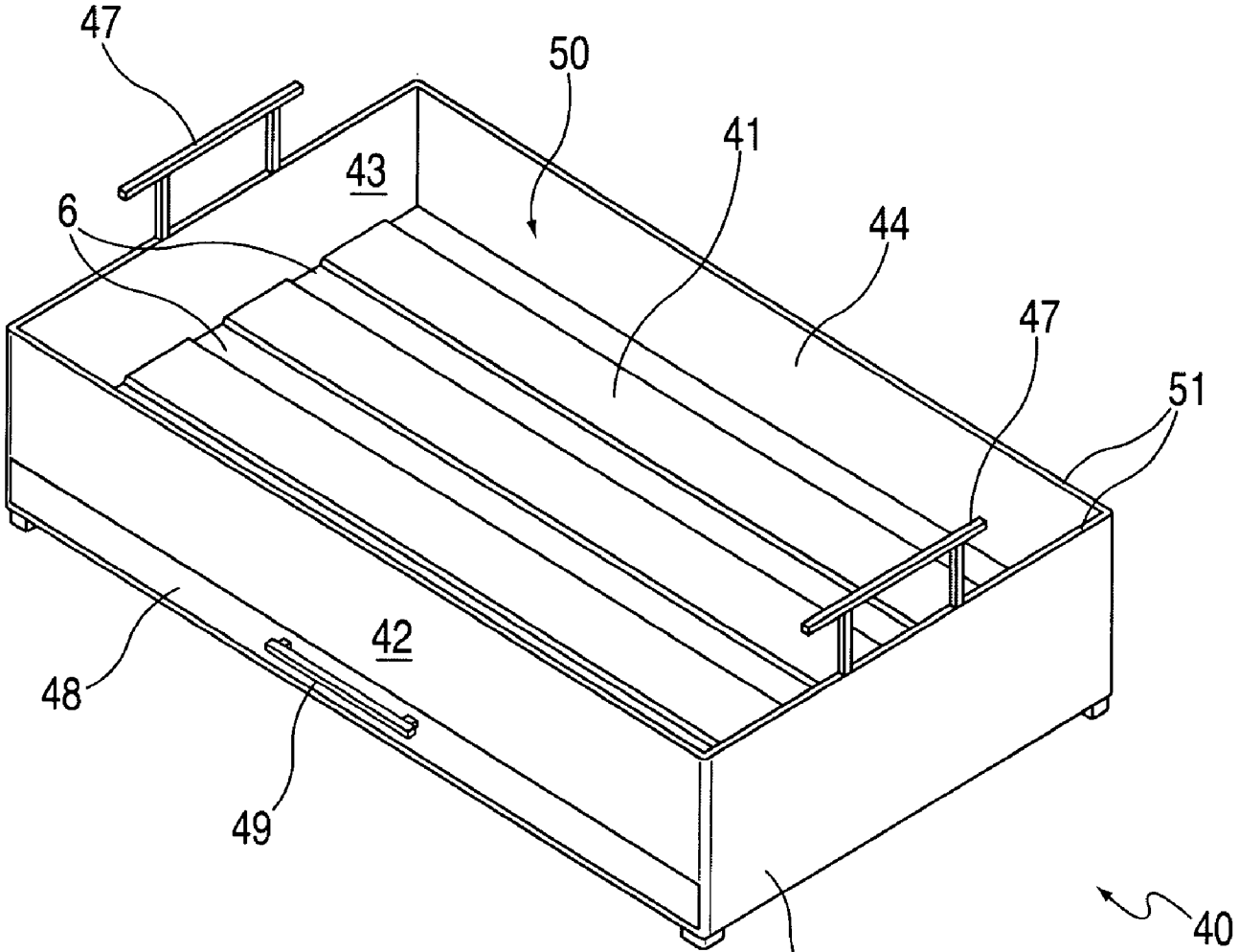
FIG. 1 is a perspective view of the tray of the cosmetic storage system of the present invention.
Figure 2A:
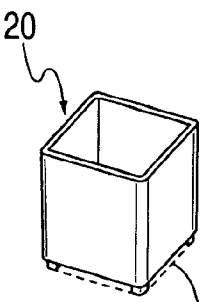
FIG. 2A-2I are perspective views of the modular boxes of the present invention.
Figure 2B:
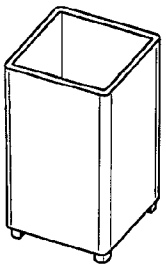
Figure 2C:
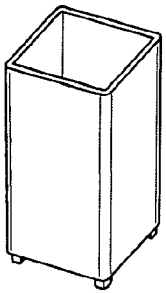
Figure 2D:
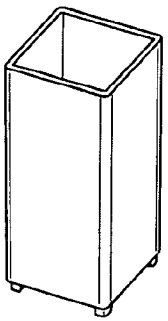
Figure 2H:
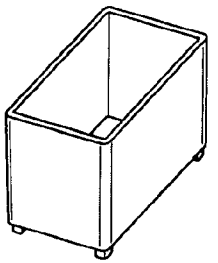
Figure 2G:
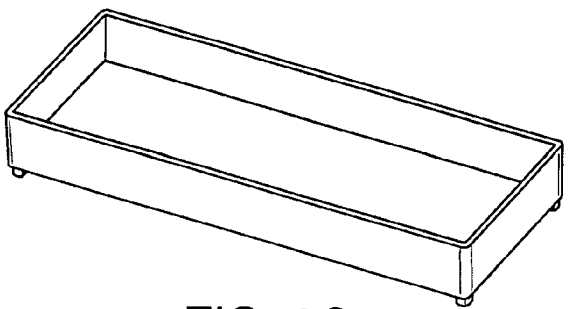
Figure 2F:
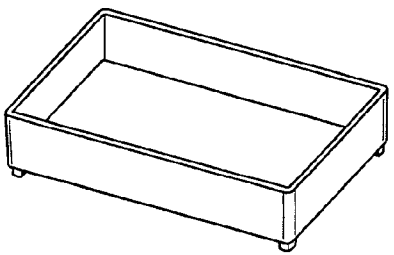
Figure 2I:
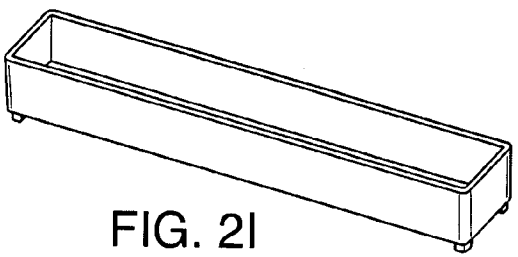
Figure 2E:
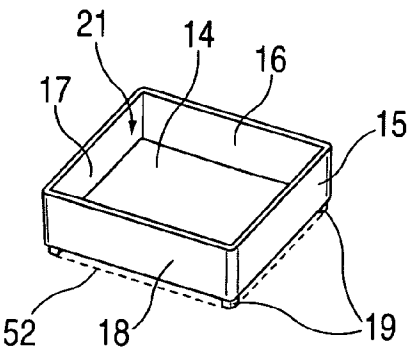

With reference to the drawings, wherein the same reference number indicates the same element throughout, there is shown in FIG. 1 a perspective view of the tray 40 of the cosmetic storage system of the present invention. As shown in FIG. 1 the tray 40 has a base 41, a first wall 42, second wall 43, third wall 44, fourth wall 45 and handles 47. The walls extend upward from the base 41 defining an internal area 50 surrounded by a circumferential edge 51. The base 41 has parallel, equally spaced apart grooves 6. The grooves 6 extend from the second wall 43 to the fourth wall 45. The tray may include handles 47. The handles 47 allow portability to the storage system. The tray 40 may include a drawer tray 48 below the base 41. The drawer tray 48 has a handle 49.

As shown in FIGS. 2A-I, the modular boxes 20 comprise a support base 14, a first wall 15, a second wall 16, a third wall 17, a fourth wall 18, and four legs 19. The first wall 15, second wall 16, third wall 17, and fourth wall 18 extend upward from a first side of the support base 14 defining an internal storage area 21 and an outer footprint 52. Each leg 19 extends from a second side of support 14 of the modular box 20. Each leg 19 may be located at each corner of the support base 14 of the modular box 20 and within the dimensions of the footprint 52. Each leg 19 of the modular box 20 is sized to fit within the grooves 6 of the base 41 of the tray 40. The footprint 52 and position of each leg 19 of each modular box 20 is correspondingly sized to be multiples of spacing between the grooves 6. FIGS. 2A-I show the nine modular boxes 20. As shown in FIGS. 2A-D the modular boxes 20 may be square in shape, with varying wall heights. These modular boxes 20 are suitable for storing various sizes of long, thing cosmetic items such as applicator brushes, eyebrow pencils, mascara wands, and eye shadow. As shown in FIG. 2E-I the modular boxes are rectangular in shape, with varying wall heights and dimensions. These modular boxes 20 are suitable for storing smaller sized cosmetic items such as lipstick tubes, eye shadow pans and compacts. Each modular box 20 may be used separately and independently. The heights of the modular boxes are sized to enable a user to see and access all the products stored within.

If the grooves are spaced at a distance of D, the footprint 52 dimension of the modular boxes 20 may be nD by mD, where n and m can be any whole numbers. In the preferred embodiment, the grooves are 1¾" and the modular boxes as shown in FIGS. 2A-I may be sized as follows: ¾"×¾", 3½"×3½", 3½"×4, 3½×4¾", 3½"×7", etc.

Figure 3:
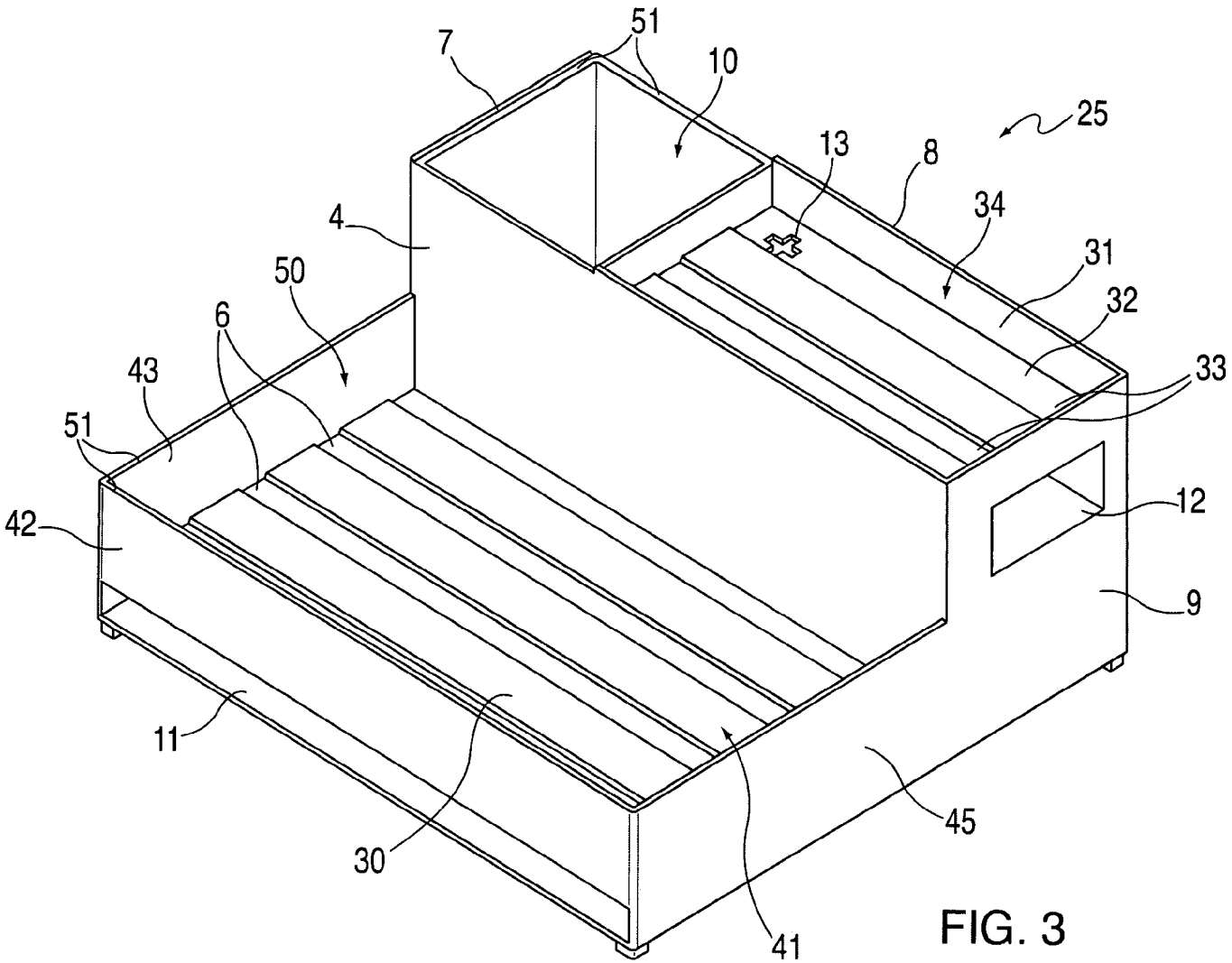
FIG. 3 is a perspective view of another embodiment of the present invention, the two-tiered tray of the present invention.
Figure 4:
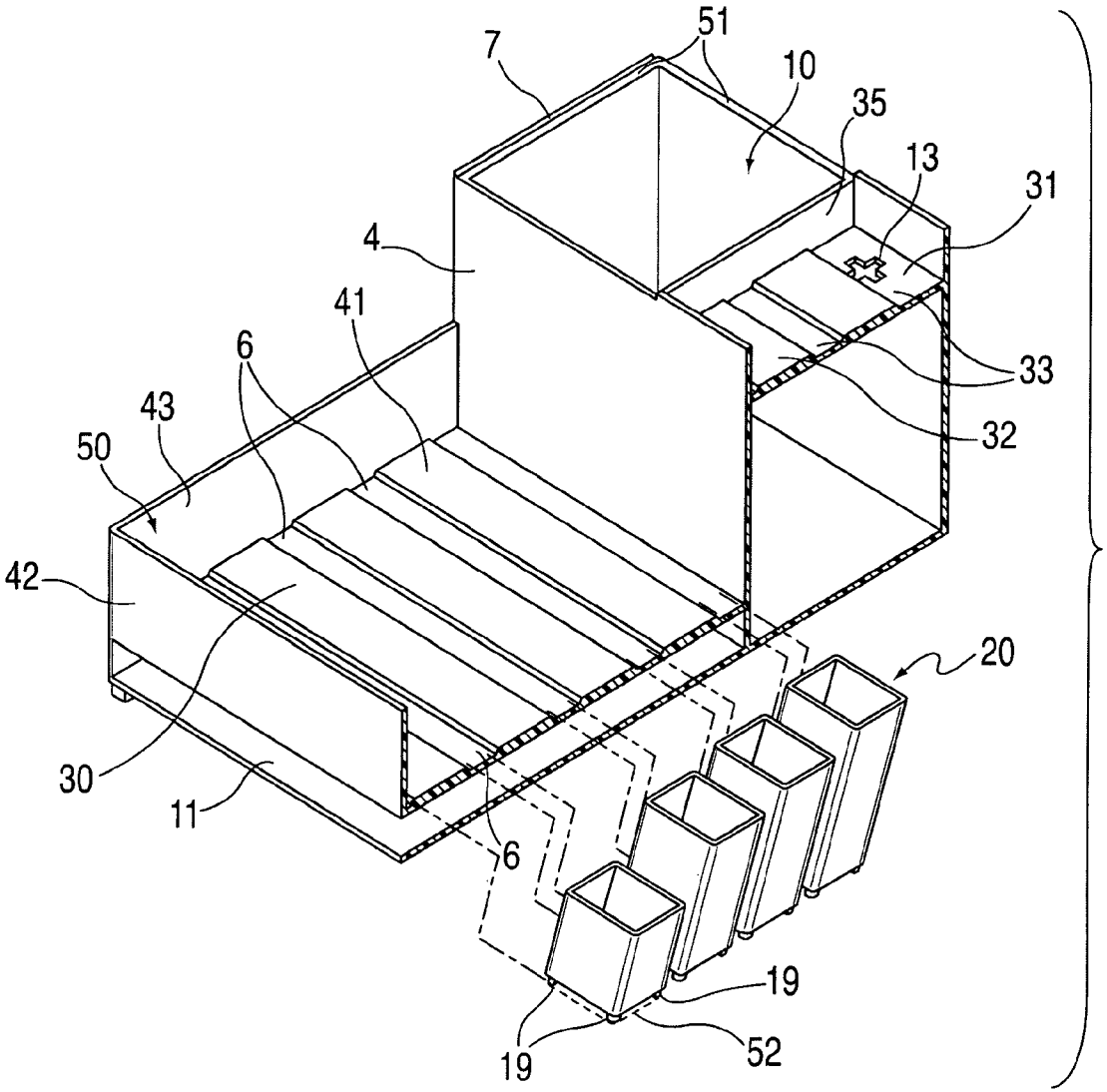
FIG. 4 is a perspective view of the two-tiered tray and modular boxes of the present invention.

FIGS. 3-4 shows another embodiment of the present invention, the two-tiered tray 25 of the present invention. The two-tiered tray 25 comprises two trays 30 & 31, each similar to tray 40 shown in FIG. 1, abutting each other and at least one modular box 20. The two abutting trays 30 & 31 share a common wall 4, with the two trays 30 & 31 in a two-tiered configuration. The second tier 31 is on an elevated platform. The first, second and fourth walls 7, 8 & 9, respectively, extend upward from the base 32 defining an internal area 34. The base 32 of the internal area 34 has parallel, equally spaced apart grooves 33. The common wall 4 extends higher than the other walls 2, 3 and 5 of the tray 30 to allow the two-tiered configuration. This embodiment of the modular system 25 further includes an open compartment 10 abutting the two trays 30 & 31 and sharing a common wall with each of the trays 30 & 31. The open compartment 10 may be sized to accept a tissue box, holder or dispenser. Below the elevated platform of the second tier tray 31 can be a slot for inserting a pencil sharpener 12. The pencil sharpener 12 may be removable. The two-tiered tray 25 further comprises an open compartment 11 sharing common walls 45 & 43. The open compartment 11 may be sized to accept a drawer.

Figure 5:
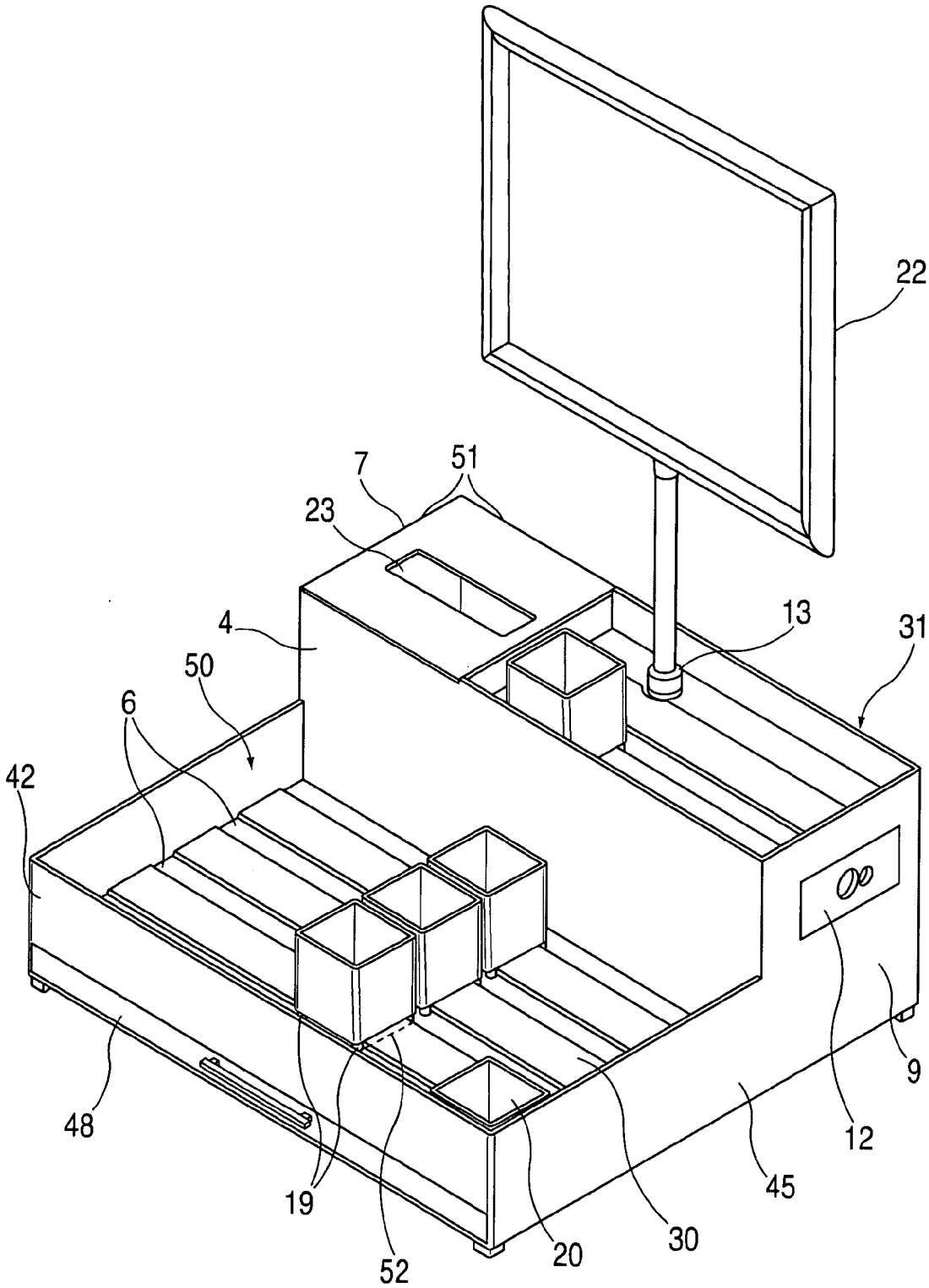
FIG. 5 is a perspective view of the two-tiered tray assembled with the modular boxes of the present invention.

FIG. 5 is a perspective view of the two-tiered tray 25 assembled with the modular boxes 20 of the present invention. FIG. 5 shows the second tier 31 further comprising an aperture 13. The aperture 13 is sized to cooperatively engage a correspondingly sized handle of a mirror 22. The mirror 22 may be detachable from the second tier tray 31. The handle of the mirror 22 may be bendable and removable to facilitate transport of the system. The mirror 22 may be lighted. FIG. 5 further shows the various modular boxes 20 with the legs 19 fit within the grooves 6 of the first tier tray 30 and within the grooves 33 of the second tier 31. Each modular box 20 is fit within the grooves 33 and abuts the other modular boxes 20 within the same tier.

The legs 19 of modular boxes 20 can be placed into grooves 6, with no attachment to the tray. Even without any attachment, the internal area 50 defined by the four walls prevent the modular boxes from tipping over and secure them. The legs 19 of the modular boxes and the grooves 6 in the tray can have magnetic elements for secured attachment (not shown). Grooves 6 and legs 19 may be also be secured to each other with a tongue & groove configuration (not shown).

Figure 6:
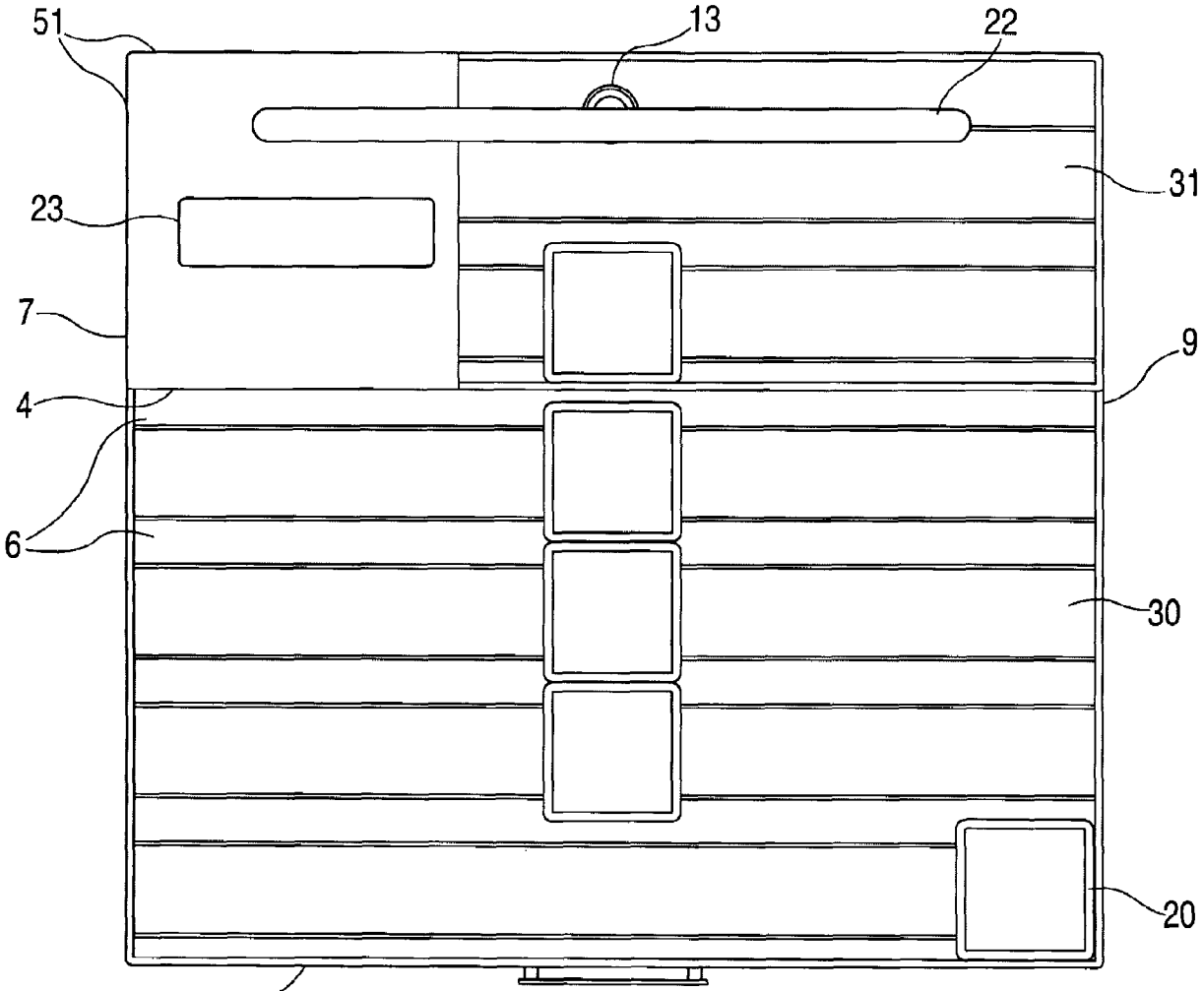
FIG. 6 is a top view of the two-tiered tray assembled with the modular boxes of the present invention.

FIG. 6 is a top view of the two-tiered tray assembled with the modular boxes of the present invention.

Figure 7:
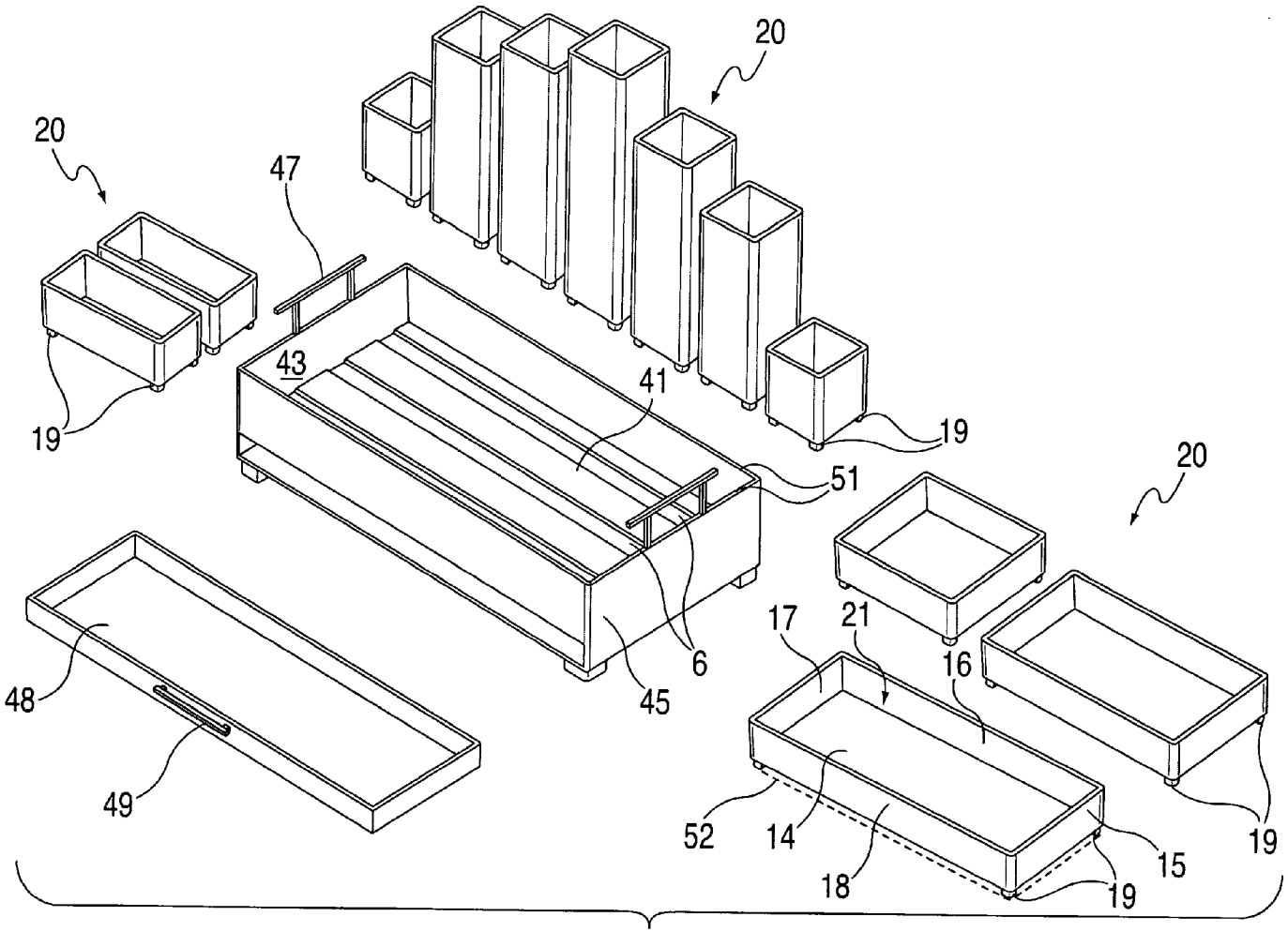
FIG. 7 is a perspective view of the tray shown in FIG. 1 showing various combinations of modular boxes of the cosmetic storage system of the present invention.

FIG. 7 is a perspective view of the tray shown in FIG. 1 showing various combinations of modular boxes of the cosmetic storage system of the present invention.

The features of the invention illustrated and described herein are the preferred embodiments. Therefore, it is understood that the appended claims are intended to cover unforeseeable embodiments with insubstantial differences that are within the spirit of the claims.

What I claim is:

1. A modular cosmetic storage system, comprising:

at least one tray, each tray having a planar base with at least one wall extending perpendicularly and upwardly from said base defining an internal area;

at least two parallel, spaced apart, grooves on a surface of said planar base, each said groove being spaced apart at a distance D from another groove; and at least two modular boxes, each modular box having a rectangular or square shape support base, said support base having first and second opposing sides, at least one wall extending perpendicularly and upwardly from said first side of said support base defining a storage area, and four legs extending perpendicularly and downwardly from said second side of said support base with one leg adjacent each corner of said support base, said support base of each said modular box is dimensioned nD by mD wherein n and m are whole numbers, and said internal area of each said tray is dimensioned xD by yD wherein x and y are whole numbers larger than n and m, respectively, wherein each of said four legs of said support base of each modular box cooperatively engages said grooves on said planar base such that each said modular box is abuttingly located within said internal area with said planar base of said tray being substantially parallel and equidistant from said support base of each modular box and one wall of each modular box abuts at least one wall of another modular box.

2. The cosmetic storage system of claim 1 wherein said at least one tray comprises first and second trays abutting each other defining, respectively, first and second internal areas.

3. The cosmetic storage system of claim 2 wherein said first and second trays share a common wall.

4. The cosmetic storage system of claim 3 wherein said second tray is on an elevated platform.

5. The cosmetic system of claim 4 wherein said elevated platform further comprises a pencil sharpener.

6. The cosmetic system of claim 1 wherein said planar base having an aperture on said planar base.

7. The cosmetic system of claim 6 further comprising a mirror having a handle, wherein said aperture having internal threading that correspondingly engages said handle of said mirror.

8. The cosmetic system of claim 1 wherein each tray having a peripheral edge and first and second walls, said first wall extending upwardly from a peripheral edge of said tray and said second wall extending from a non-peripheral edge of said tray defining first and second internal areas with said second wall being a common wall.

9. The cosmetic storage system of claim 1 further comprising at least one handle on said at least one wall of said tray.

10. The cosmetic storage system of claim 1 further comprising an opening adjacent said planar base of one of said at least one tray, wherein said opening is capable of accepting a drawer.

* * * * *